US006393860B1

(12) United States Patent
Heschel et al.

(10) Patent No.: US 6,393,860 B1
(45) Date of Patent: May 28, 2002

(54) METHOD AND DEVICE FOR REFRIGERATING A SAMPLE

(76) Inventors: Ingo Heschel; Guenter Rau, both of Pauwelsstrasse 20, Aachen (DE), D-52074

( * ) Notice: Subject to any disclaimer, the term of this patent is extended or adjusted under 35 U.S.C. 154(b) by 0 days.

(21) Appl. No.: 09/486,093

(22) PCT Filed: Aug. 20, 1998

(86) PCT No.: PCT/DE98/02427

§ 371 (c)(1),
(2), (4) Date: May 12, 2000

(87) PCT Pub. No.: WO99/10693

PCT Pub. Date: Mar. 4, 1999

(30) Foreign Application Priority Data

Aug. 21, 1997 (DE) ..... 197 36 372

(51) Int. Cl.[7] ..... F25D 17/02
(52) U.S. Cl. ..... 62/376; 62/64
(58) Field of Search ..... 62/341, 373, 374, 62/375, 376, 64

(56) References Cited

U.S. PATENT DOCUMENTS 3,074,247 A * 1/1963 Polk
4,018,911 A 4/1977 Lionetti et al. ..... 424/101
4,251,995 A * 2/1981 Pert et al. ..... 62/341
4,480,682 A * 11/1984 Kaneta et al. ..... 62/434
4,799,358 A * 1/1989 Knopf et al. ..... 62/457

FOREIGN PATENT DOCUMENTS

| | | |
|---|---|---|
| DE | 31 42 521 C2 | 7/1983 |
| DE | 38 22 589 A1 | 1/1990 |
| DE | 42 06 705 A1 | 9/1993 |
| DE | 44 37 091 A1 | 4/1996 |
| DE | 196 19 152 A1 | 11/1997 |
| EP | 0 448 292 A2 | 9/1991 |
| EP | 0 475 144 A2 | 3/1992 |
| EP | 0 475 144 A3 | 3/1992 |
| FR | 2 632 391 A1 | 6/1988 |
| WO | WO 96/21351 | 7/1996 |

* cited by examiner

*Primary Examiner*—Henry Bennett
*Assistant Examiner*—Mohammad M. Ali
(74) *Attorney, Agent, or Firm*—Steven J. Hultquist

(57) ABSTRACT

To improve the thermal transmission during freezing processes it is proposed that the goods to be cooled and a pre-cooled body of high thermal capacity be pressed against each other.

Figure 1:
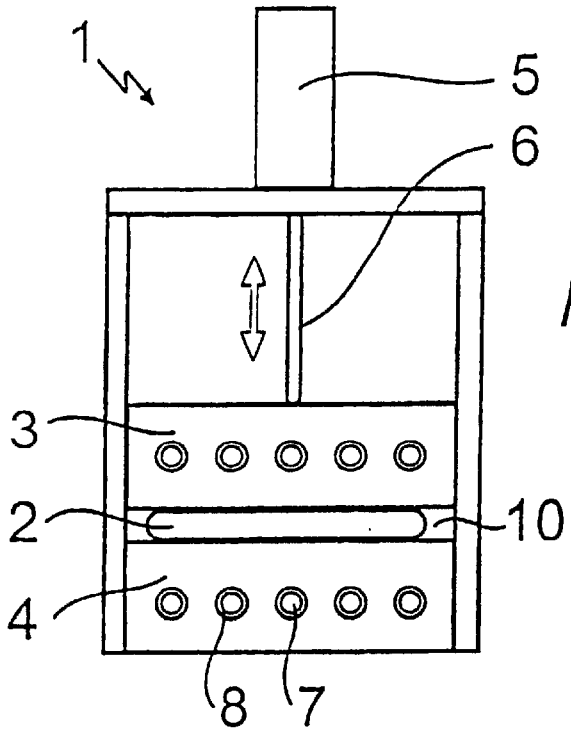

Improved thermal transmission is also attained with a device comprising a holding device which during the cooling process holds the goods to be cooled essentially in a non-deformable way, allowing direct contact between the coolant and the goods to be cooled. Preferably, vertically aligned channels are arranged between the holding device and the goods to be cooled, with coolant flowing in said channels.

17 Claims, 2 Drawing Sheets

METHOD AND DEVICE FOR REFRIGERATING A SAMPLE

The invention relates to a device for cooling, in particular freezing, goods to be cooled, in particular biological materials.

Devices for freezing biological materials are known from cryobiology.

In many fields of biological specimen preparation as well as intense-cooling conservation or vitrification of cells, organs or organisms or other biological materials, for various reasons it is crucial to cool specimens as fast as possible.

In the case of biological specimen preparation by cryotechniques e.g. for histology examinations, it is important that the specimen morphology be maintained as far as possible in spite of cooling the specimen. This requires rapid cooling to keep the extent of ice formation to a minimum.

Devices for freezing blood cells are particularly well researched. With these devices, antifreeze additives such as for example hydroxyethyl starch (HES) or glycerine is added to the blood components; said additives are necessary to achieve an adequate cell survival rate after the freeze-thaw process. The blood components present in a film bag are placed in a container which is subsequently cooled by immersion in e.g. liquid nitrogen.

To achieve a good ratio of surface to volume at the bag and to avoid creases and bulges at the bag, DE 31 42 521 C2 and DE-A-44 37 091 propose that the bag be held between two plates arranged parallel in respect of each other, and that the bag be cooled in the liquid nitrogen together with the holding device. A similar holding device is also known from WO 90/09184.

From U.S. Pat. No. 4,018,911 a holding device is known where the bags are positioned loosely in a perforated holding device so that the coolant can reach the bags also through the holding device.

However, the known holding devices have a disadvantage in that thermal transmission from the coolant to the biological material is impeded by the holding device.

It is thus the object of the invention to provide a device of the generic type which allows acceleration of the cooling process of goods to be cooled.

The object of the invention is met by a generic device comprising a holding device which during the cooling process holds the goods to be cooled essentially in a non-deformable way and forms at least one space which allows direct contact between the coolant and the goods to be cooled, with channels for conducting the coolant being provided between the holding device and the goods to be cooled.

Preferably, the space extends at least partly along the goods to be cooled.

In the case of boiling coolants, the guide channels for conducting the coolant allow free convection or pumping of the coolant through the channels.

The holding device according to the invention is constructed such that it holds in particular liquid blood components filled into bags in a shape that is advantageous for cooling while nevertheless allowing direct contact between the coolant and the goods to be cooled. This not only results in optimum holding of the goods to be cooled but also in avoiding the problems, known from the state of the art, of thermal transmission from the goods to be cooled through the holding device into the coolant.

To achieve good thermal transmission from the goods to be cooled to the coolant, it is proposed that the contact surface between the holding device and the goods to be cooled be smaller than the contact surface between the coolant and the goods to be cooled.

Trials have shown that convection through evaporation itself, within the described guide channels, results in strong acceleration of the coolant if the inlet of the guide channels is arranged lower than their outlet.

This chimney effect is so pronounced that it is proposed that flow-control devices which are adjustable so as to restrict the flow, be arranged at the inlet and/or the outlet. This makes it possible to achieve control or regulation of the coolant flow in a simple way. It is advantageous if the adjustable flow-control devices are adjustable also during the cooling process, so that variations in the cooling rates between the margin and the middle of the specimen can be compensated for by regulation, because otherwise different local survival rates could result.

Simple construction of the device is achieved in that the holding device holds the goods to be cooled in the form of a plate. In particular good cooling rates can be achieved by cooling both sides of the plate-shaped goods to be cooled.

The goods to be cooled can however also be held in the form of a cylinder. Particularly advantageous is a holding device which holds the goods to be cooled in the form of a hollow cylinder because in this way the goods to be cooled encompass a hollow space which can serve as a guide channel for the coolant.

Since in the range of the boiling temperature of the coolant the best cooling rate can be achieved with nucleate boiling, a chamber is proposed into which the holding device can be inserted, with said chamber preferably being heatable. The ability to heat the chamber allows precise setting of the evaporation rate of the coolant and thus of the convection. Alternatively or additionally, the holding device itself can be constructed so as to be heatable.

It is advantageous if the chamber comprises an inlet with a coolant pump. In this way forced flow of the coolant through the chamber and between the goods to be cooled and the holding device can be achieved, with said forced flow improving the thermal transmission from the goods to be cooled to the coolant.

A preferred embodiment provides for the chamber to comprise an overflow and a separator for liquid coolant. While the liquid coolant is used for further cooling, the gaseous part of the coolant is either discarded or liquefied in a connected device.

A preferred use of the device described comprises the freezing of bags filled with a liquid, in particular blood components. These bags are flexible in shape; they have to be cooled as fast as possible. Although antifreeze additives limit the damage to blood components, particularly high rates of cooling should be achieved. This can be achieved in a simple way with the device described.

When cooling bodies and in particular when cooling liquids, the volume of the goods to be cooled changes, in the case of aqueous systems in addition also due to crystallisation.

It is thus proposed that the holding device described essentially be pressed against the goods to be cooled, at a constant pressure. This can for example be achieved by a pre-tensioned spring with flat spring characteristics, with pneumatic or hydraulic devices. In particular, a hydraulic or pneumatic device with respective control makes it possible to keep the pressure against the goods to be cooled essentially constant. Although the volume increase during crystallisation can principally be absorbed by regulating the pressure, it is additionally advantageous if the film bag is not completely filled, but instead, if a gas cushion is left above the goods to be frozen. In this way the welded seams of the bag are not unduly stressed by the expansion in volume.

In order to improve the thermal transmission at the holding device, it is proposed that the holding device comprise a microporous surface on the side of the coolant. To form a microporous surface, either the surface itself can be roughened or an adhesive layer with a microporous surface, for example Leukosilk® can be applied to the surface. It is particularly advantageous if this microporous layer is fixed directly to the bag.

Depending on the device selected, or depending on the desired cooling progression, prior to cooling the goods to be cooled, the temperature of the holding device can be below the solidification temperature of the goods to be cooled. But it is also possible that the temperature of the holding device is above the solidification temperature of the goods to be cooled.

Figure 2:
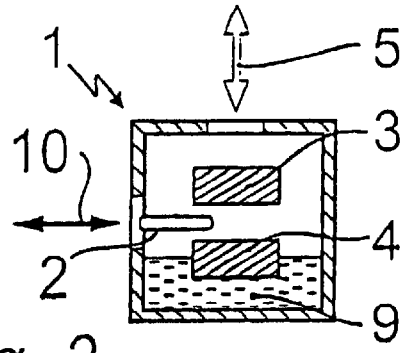
Figure 3:
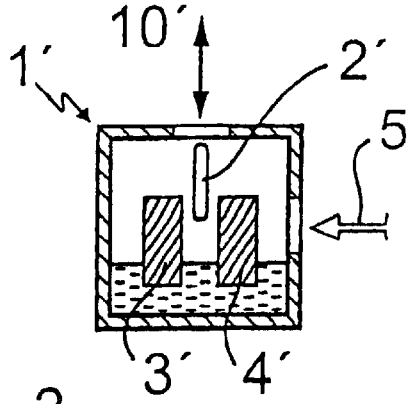
Figure 4:
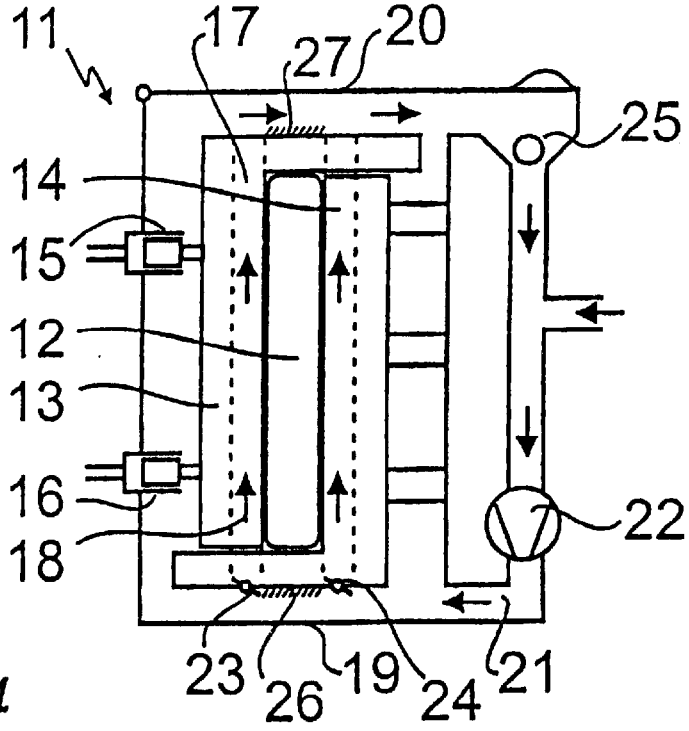

To illustrate the device described, several embodiments are shown in the drawing and are described in more detail below. The following are shown:

FIG. 1 a diagrammatic lateral view of a device with a holding device with cooling ribs;

FIG. 2 a section through the device according to FIG. 1;

FIG. 3 a diagrammatic view of a device for free convection with heating device; and FIG. 4 an alternative embodiment of a device for free convection with heating device.

Figure 5:
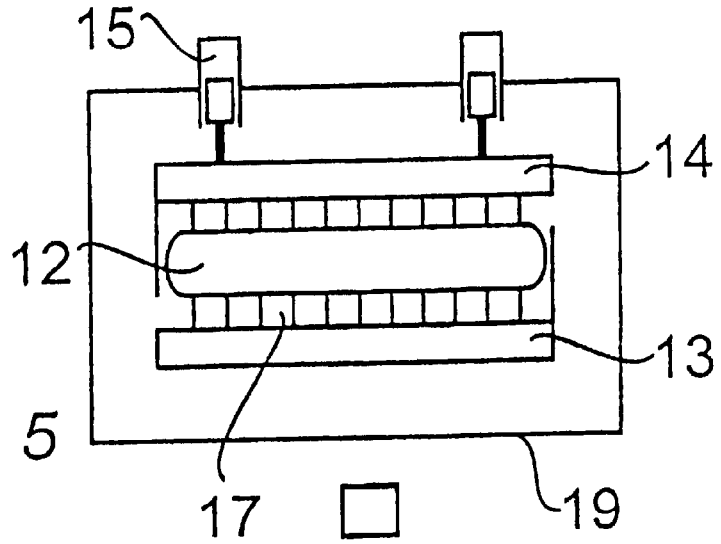
Figure 6:
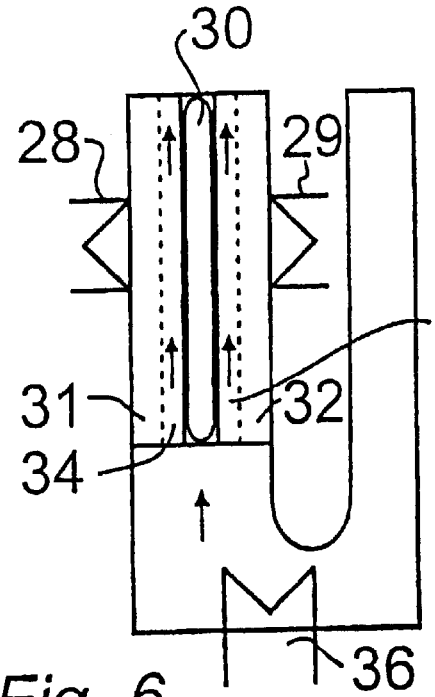
Figure 7:
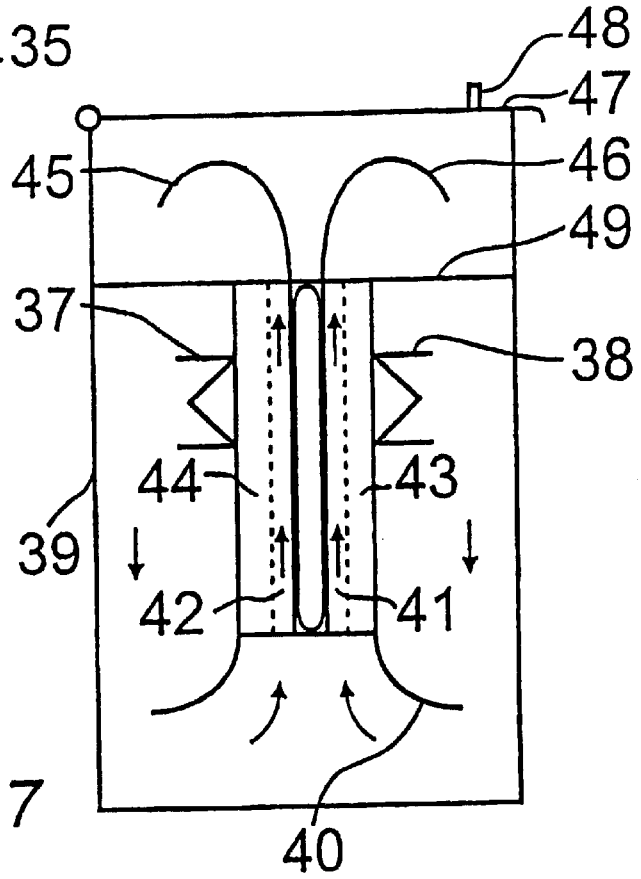

FIG. 5 a section through the device according to FIG. 4;

FIG. 6 a diagrammatic view of a device for free convection with heating device; and FIG. 7 an alternative embodiment of a device for free convection with heating device.

FIG. 1 shows a further device 11 for freezing or cooling a cooling bag 12. The bag is jammed between two L-shaped plates 13 and 14 which completely encompass the bag 12. The plates 13 and 14 are pressed together by way of pneumatic cylinders 15, 16, such that the cooling bag 12 is firmly held between the plates.

On their sides facing the bag 12, the plates 13 and 14 comprise a comb-like structure, shown in FIG. 2. In this way channels 17 form when the plates 13, 14 are pressed against the cooling bag 12, with coolant being able to rise in said channels 17, along the arrows 18, between the plates and the cooling bag 12.

The plates 13, 14 and the cooling bag 12 are arranged in a chamber 19 which is closed by a lid 20. The plates are arranged at a distance from the bottom of the chamber so as to allow streaming movement below the plate. By way of the pipe 21 and the pump 22, liquid nitrogen is pumped into this chamber. This liquid nitrogen first accumulates on the bottom of the chamber 19 before rising in the channels 17. In so doing it heats up and changes to the vapour phase. The channels 17 have a chimney effect leading to a particularly strong flow within the channels. In order to regulate this flow, flaps 23, 24 are provided at the entrance of the channels 17. The nitrogen emanating from the upper end of the channels 17 flows to a separator 25 which separates liquid nitrogen from gaseous nitrogen. The separator 25 comprises a vapour exit aperture through which the gaseous nitrogen is educted.

In those positions where the plates 13 and 14 are arranged directly between the coolant and the cooling bag 12, a microporous layer 26, 27 is provided which improves thermal transmission from the coolant to the plate and thus thermal transition to the cooling bag. The cooling performance could be further improved if the surface of the cooling bag 12, at least in the region of the channels 17 and/or further surface regions of the plates 13, 14 which are in contact with the liquid nitrogen, comprises a microporous layer.

FIG. 3 is a diagrammatic arrangement of a device according to FIG. 1 with heating elements 28 and 29 which are arranged on the sides of the plates 31 and 32, said sides facing the cooling bag 30. In this way the flow speed in the channels 34, 35 can be increased and regulated. A further heating element 36 is provided in the bottom region of the device, again so as to improve and regulate the flow of the coolant. In this variant, the liquid part of the coolant emerging upward is collected in a device (not shown).

FIG. 4 shows a further alternative embodiment of the device according to FIG. 1 comprising two heating devices 37, 38 for the holding devices 43, 44. In this variant, the coolant moves downward in the exterior region of a container 39; it is conducted to the channels 41 and 42 in the plates 43 and 44 by way of a funnel 40. Above the channels 41 and 42, deflectors 45, 46 are provided which return liquid coolants issuing from the channels 41, 42. Above the deflectors 45, 46, a lid 47 with a gas outlet 48 is provided. The liquid level 49 of the coolant is kept just above the cooling bag but below the deflectors 45, 46. In this way the consumption of liquid nitrogen is reduced.

In the embodiments according to FIG. 3 and 4, too, the lower inlet of the channels can be regulated by flaps.

The embodiments according to FIGS. 1, 2, 3 and 4 can either be operated so that the goods to be cooled and the container or the plates are at first held above the solidification temperature of the goods to be cooled, or the container or the plates can already be precooled and only the goods to be cooled can be held above the solidification temperature before they are placed into the device.

What is claimed is:

1. A sample-cooling device comprising at least one precooled body delimiting a cooling space for the sample, wherein at least one precooled body has a mass in grams that is at least 2.5 times the volume of the cooling space in milliliters, and wherein the precooled body comprises at least one space which permits formation of a contact surface and allows direct contact between a coolant and the sample.

2. A device for cooling a sample, the device comprising:

(a) a holding device arranged:

(i) to hold the sample in an essentially non-deformable manner; and (ii) to form at least one contact surface between the holding device and the sample; and (b) at least one space which permits formation of a contact surface and allows direct contact between a coolant and the sample.

3. The device of claim 2 wherein the contact surface between the holding device and the sample is smaller than the contact surface between the coolant and the sample.

4. The device of claim 2 wherein the holding device comprises guide channels for conducting the coolant.

5. The device of claim 4 wherein the guide channels comprise an inlet and an outlet and wherein the inlet is positioned at a level which is lower than the level of the outlet.

6. The device of claim 5 further comprising at least one adjustable flow-control device arranged to restrict flow of coolant at the inlet and/or the outlet.

7. The device of claim 2 wherein the holding device is arranged to hold a plate-shaped sample.

8. The device of claim 2 wherein the holding device is arranged to hold a sample having a cylindrical or a hollow-cylindrical shape.

9. A device for cooling a sample, the device comprising:

(a) a holding device arranged:

(i) to hold the sample in an essentially non-deformable manner; and (ii) to form at least one contact surface between the holding device and the sample;

(b) at least one space which permits formation of a contact surface and allows direct contact between a coolant and the sample, and (c) a heatable chamber surrounding the holding device.

10. The device of claim 9 wherein the chamber comprises an inlet for flowing coolant into the chamber.

11. The device of claim 9 wherein the chamber comprises an overflow and a separator for liquid coolant.

12. The device of claim 2, wherein the sample is a freezing bag filled with a liquid.

13. The device of claim 12, wherein the freezing bag comprises a microporous surface.

14. The device of claim 12, wherein the holding device is kept at a temperature that is below the solidification temperature of the liquid in the freezing bag prior to cooling of said freezing bag.

15. The device of claim 12, wherein the holding device is kept at a temperature that is above the solidification temperature of the liquid in the freezing bag prior to cooling of said freezing bag.

16. The device of claim 2, wherein the holding device is pressed against the sample at an essentially constant pressure.

17. The device of claim 2, wherein the contact surface between the holding device and the sample comprises a microporous surface.

* * * * *

UNITED STATES PATENT AND TRADEMARK OFFICE

CERTIFICATE OF CORRECTION

PATENT NO. : 6,393,860 B1
DATED : May 28, 2002
INVENTOR(S) : Heschel et al.

It is certified that error appears in the above-identified patent and that said Letters Patent is hereby corrected as shown below:

Column 2,
Line 24, "-in" should be -- in --

Signed and Sealed this

Fourteenth Day of September, 2004

JON W. DUDAS
*Director of the United States Patent and Trademark Office*

UNITED STATES PATENT AND TRADEMARK OFFICE

CERTIFICATE OF CORRECTION

PATENT NO. : 6,393,860 B1
DATED : May 28, 2002
INVENTOR(S) : Heschel et al.

It is certified that error appears in the above-identified patent and that said Letters Patent is hereby corrected as shown below:

Replace Column 1 thru Column 8 with the attached

Signed and Sealed this

Eleventh Day of January, 2005

JON W. DUDAS
*Director of the United States Patent and Trademark Office*

METHOD AND DEVICE FOR REFRIGERATING, ESPECIALLY FREEZING, GOODS

The invention relates to a method and a device for cooling, in particular freezing, goods to be cooled, in particular biological materials.

Devices and methods for freezing biological materials are known from cryobiology.

In many fields of biological specimen preparation as well as intense-cooling conservation or vitrification of cells, organs or organisms or other biological materials, for various reasons it is crucial to cool specimens as fast as possible.

In the case of biological specimen preparation by cryotechniques e.g. for histology examinations, it is important that the specimen morphology be maintained as far as possible in spite of cooling the specimen. This requires rapid cooling to keep the extent of ice formation to a minimum.

Devices for freezing blood cells are particularly well researched. With these devices, antifreeze additives such as for example hydroxyethyl starch (HES) or glycerine is added to the blood components; said additives are necessary to achieve an adequate cell survival rate after the freeze-thaw process. The blood components present in a film bag are placed in a container which is subsequently cooled by immersion in e.g. liquid nitrogen.

To achieve a good ratio of surface to volume at the bag and to avoid creases and bulges at the bag, DE 31 42 521 C2 and DE A 44 37 091 propose that the bag be held between two plates arranged parallel in respect of each other, and that the bag be cooled in the liquid nitrogen together with the holding device. A similar holding device is also known from WO 90/09184.

While the known holding devices provide the advantage of achieving a good ratio of surface to volume at the bag, they have a disadvantage in that thermal transmission from the coolant to the biological material is impeded by the holding device.

It is thus the object of the invention to provide a method and a device of the generic type which allow acceleration of the cooling process of goods to be cooled.

From the point of view of the method, this object is met in that the goods to be cooled are pressed against a precooled body of high thermal capacity.

The precooled body of high thermal capacity provides the advantage that, at least for an initial period of time, during heat absorption from the goods to be cooled, the body does not require aftercooling, and that the high thermal capacity of the body is selected such that ideally the body can absorb the entire heat released from the goods to be cooled without becoming significantly warmer. Consequently, thermal transition from the goods to be cooled to the coolant via the body, is not necessary during the rapid cooling process.

Advantageously, the selected thermal capacity of the precooled body is sufficient for the goods to be cooled, which are above solidification temperature, to be cooled without aftercooling to at least −18° Celsius, preferably to at least −30° Celsius. In particular, the method can be applied such that such a coolant is cooled to below solidification temperature, even if the solidification temperature strictly speaking covers a certain solidification temperature interval. The thermal capacity of the precooled body can also be selected to be sufficient for the goods to be cooled, which are at a temperature above solidification temperature, to be cooled to below glass transition temperature without aftercooling. As a result of this, the cooling process takes place in a particularly suitable manner, in particular also for vitrification.

To achieve particularly good thermal transmission from the cooled body to the goods to be cooled, according to the invention the cooled body and the goods to be cooled are pressed against each other. The pressures generated during this process of pressing together range from 0.01 bar to 4 bar (advantageously 0.1 bar to 0.4 bar overpressure) improve thermal transmission from the precooled body to the goods to be cooled. Even if the goods to be cooled are contained in a film bag, as a result of the high pressure exerted, thermal transmission from the cooled body to the film bag and from the film bag to the goods to be cooled, is improved.

By combining the use of a body of high thermal capacity and contact at high pressure, of the body to the goods to be cooled, particularly fast cooling of the goods to be cooled can be achieved so that in the case of biological material any damage to the material is prevented or at least reduced.

To achieve area contact between the cooled body and the goods to be cooled, it is proposed that the surface of the body be matched to the shape of the goods to be cooled. In the case of liquid goods to be cooled, packed in bags, the body can either be matched to the bag shape or it can press the bag into a particular shape. Liquid or deformable goods to be cooled can for example be shaped to plates to reduce the length of the thermal transition -in the goods to be cooled. By deforming the surface for example to a wave, the area of thermal transmission can be increased so as to achieve improved thermal transmission.

A further increase in thermal transmission between cooled body and goods to be cooled is achieved in that the surface is polished. A surface which is as smooth as possible prevents air inclusion between the goods to be cooled and the cooled body, as such air inclusion would impede thermal transmission.

To further force the rate of cooling it is proposed that the goods to be cooled be pressed between at least two bodies of high thermal capacity. This makes it possible to cool the goods to be cooled from several sides so as to achieve rapid cooling within the goods to be cooled.

An advantageous embodiment of the invention provides for respective surfaces of cooled bodies, arranged opposite each other, to be pressed onto the goods to be cooled so that the goods to be cooled are located in a narrow gap which for example is wave-shaped.

In order to cool the entire surface of the goods to be cooled it is proposed that the body or bodies encompass the goods to be cooled. This provides a further advantage in that the goods to be cooled are not uncontrollably deformed as a result of the forces acting on them, and that bags filled with liquid do not burst.

If the thermal capacity of the body is insufficient for achieving the required cooling rate, it is proposed that a coolant be conducted through the body. In this way the body can be aftercooled during heat absorption and in addition it is possible to cool the body again by means of the coolant guided through it, after it has released the cold. Alternatively or additionally, the body itself can be located in coolant so that coolant streams around it.

The object of the invention is also met by a device for cooling, in particular freezing, goods to be cooled, in particular biological material, in which at least one precooled body delimits a cooling space for the goods to be cooled, in that the mass of the precooled body in g (gram) is at least two point five (2.5) times the volume of the cooling space in ml (milliliters).

Such a ratio can ensure an excellent cooling process of the goods to be cooled which allows sufficiently rapid cooling for many purposes. In this context, cooling space refers to the volume which during cooling is taken up by the goods to be cooled or which is delimited by the precooled body.

Improved results can be achieved if the above-mentioned ratio is at least five (5). In particular from a ratio of thirty (30), preferably from a ratio of fifty (50) a device results which ensures particularly fast cooling rates. The devices described above are particularly suitable for goods to be cooled from 1 mg mass upward. In particular they are suitable for goods to be cooled above 1 g or for macroscopic goods to be cooled, such as for example cool conserves.

The object of the invention is also met by a device comprising a holding device which during the cooling process holds the goods to be cooled essentially in a non-deformable way and which allows direct contact between the coolant and the goods to be cooled.

Another object of the invention is met by a process for cooling, in particular freezing, goods to be cooled, in particular biological materials, in which during the cooling process the goods to be cooled are essentially held in a non-deformable way and brought into direct contact with a coolant in at least one space.

Preferably, the space extends at least partly along the goods to be cooled.

The holding device according to the invention is constructed such that it holds in particular liquid blood components filled into bags in a shape that is advantageous for cooling while nevertheless allowing direct contact between the coolant and the goods to be cooled. This not only results in optimum holding of the goods to be cooled but also in avoiding the problems, known from the state of the art, of thermal transmission from the goods to be cooled through the holding device into the coolant.

To achieve good thermal transmission from the goods to be cooled to the coolant, it is proposed that the contact surface between the holding device and the goods to be cooled be smaller than the contact surface between the coolant and the goods to be cooled.

An advantageous embodiment of the device provides for the holding device to comprise guide channels for conducting the coolant. In particular in the case of boiling coolants, this allows free convection or pumping of the coolant through the channels.

Trials have shown that convection through evaporation itself, within the described guide channels, results in strong acceleration of the coolant if the inlet of the guide channels is arranged lower than their outlet.

This chimney effect is so pronounced that it is proposed that flow-control devices which are adjustable so as to restrict the flow, be arranged at the inlet and/or the outlet. This makes it possible to achieve control or regulation of the coolant flow in a simple way. It is advantageous if the adjustable flow-control devices are adjustable also during the cooling process, so that variations in the cooling rates between the margin and the middle of the specimen can be compensated for by regulation, because otherwise different local survival rates could result.

Simple construction of the device is achieved in that the holding device holds the goods to be cooled in the form of a plate. In particular good cooling rates can be achieved by cooling both sides of the plate-shaped goods to be cooled.

The goods to be cooled can however also be held in the form of a cylinder. Particularly advantageous is a holding device which holds the goods to be cooled in the form of a hollow cylinder because in this way the goods to be cooled encompass a hollow space which can serve as a guide channel for the coolant.

Since in the range of the boiling temperature of the coolant the best cooling rate can be achieved with nucleate boiling, a chamber is proposed into which the holding device can be inserted, with said chamber preferably being heatable. The ability to heat the chamber allows precise setting of the evaporation rate of the coolant and thus of the convection. Alternatively or additionally, the holding device itself can be constructed so as to be heatable.

It is advantageous if the chamber comprises an inlet with a coolant pump. In this way forced flow of the coolant through the chamber and between the goods to be cooled and the holding device can be achieved, with said forced flow improving the thermal transmission from the goods to be cooled to the coolant.

A preferred embodiment provides for the chamber to comprise an overflow and a separator for liquid coolant. While the liquid coolant is used for further cooling, the gaseous part of the coolant is either discarded or liquefied in a connected device.

A preferred use of the method or the device described comprises the freezing of bags filled with a liquid, in particular blood components. These bags are flexible in shape; they have to be cooled as fast as possible. Although antifreeze additives limit the damage to blood components, particularly high rates of cooling should be achieved. This can be achieved in a simple way with the method or device described.

When cooling bodies and in particular when cooling liquids, the volume of the goods to be cooled changes, in the case of aqueous systems in addition also due to crystallization. It is thus proposed that the body or the holding device described essentially be pressed against the goods to be cooled, at a constant pressure. This can for example be achieved by a pre-tensioned spring with flat spring characteristics, with pneumatic or hydraulic devices. In particular, a hydraulic or pneumatic device with respective control makes it possible to keep the pressure against the goods to be cooled essentially constant. Although the volume increase during crystallization can principally be absorbed by regulating the pressure, it is additionally advantageous if the film bag is not completely filled, but instead, if a gas cushion is left above the goods to be frozen. In this way the welded seams of the bag are not unduly stressed by the expansion in volume.

In order to improve the thermal transmission at the body or at the holding device, it is proposed that the body or the holding device comprise a microporous surface on the side of the coolant. To form a microporous surface, either the surface itself can be roughened or an adhesive layer with a microporous surface, for example Lykosilk® can be applied to the surface. It is particularly advantageous if this microporous layer is fixed directly to the bag.

Depending on the device selected, or depending on the desired cooling progression, prior to cooling the goods to be cooled, the temperature of the body or of the holding device can be below the solidification temperature of the goods to be cooled. But it is also possible that the temperature of the body or of the holding device is above the solidification temperature of the goods to be cooled.

To illustrate the method and the device described, several embodiments are shown in the drawing and are described in more detail below. The following are shown:

FIG. 1 a diagrammatic view of a device for pressing cooled bodies against goods to be cooled;

FIG. 2 the principle of horizontal feeding-in of goods to be cooled;

FIG. 3 the principle of vertical feeding-in of goods to be cooled;

FIG. 4 a diagrammatic lateral view of a device with a holding device with cooling ribs;

FIG. 5 a section through the device according to FIG. 4;

FIG. 6 a diagrammatic view of a device for free convection with heating device; and FIG. 7 an alternative embodiment of a device for free convection with heating device.

The device 1 shown in FIG. 1 serves to cool a cooling bag 2 held between two plates 3 and 4. These plates 3 and 4 in a cooling space 10 are made from metal such as steel or preferably copper; they have a high thermal capacity. A pneumatic cylinder 5 is connected to the plate 3 by way of a piston rod 6 so that the plate 3 can be pressed with considerable force parallel against the cooling bag 2. As a result, the cooling bag 2 is jammed between the plates 3 and 4. As an alternative, guiding the plates 3 and 4 can also be realized by a pulley system or by a system comprising one or several cogs, joints or chains. In this way the movement of the plate can take place by way of a drive arranged outside the intensely cooled region, for example by way of a pneumatic cylinder. Plates 3 and 4 can either be cooled by liquid nitrogen streaming over them, or by liquid nitrogen being conducted through the pipelines 7 through the plates so as to cool the plates. To increase thermal transmission within the pipelines 7, the interior surfaces of the pipes are coated with a microporous layer 8.

The use of the device 1 is shown diagrammatically in FIG. 2. First at least one plate is cooled down to the desired temperature by means of liquid nitrogen 9; subsequently a cooling bag 2 is placed onto the lower plate 4 by means of a special template. In this connection, existing circular punchouts at the margin of the cooling bags can be used to fix the cooling bag within the cooling container, for example by holding arbours. By means of the pneumatic device 5, the plate 3 is pressed against the cooling bag 2 so that the heat from bag 2 is transferred to the plates 3 and 4. After cooling of the cooling bag 2, the plate 3 is raised by means of the pneumatic device 5, and the cooling bag 2 is removed from the device 1 in the direction of the actuation arrow 10.

FIG. 3 shows an alternative variant of the device. In this device 1' the cooling bag 2' is placed between two vertically arranged plates 3' and 4' and the cooled plates 3' and 4' are pressed against the bag 2' by means of the pneumatic device 5'. After cooling the bag 2' it is removed from the device 1' in vertical direction according to the actuation arrow 10'.

FIG. 4 shows a further device 11 for freezing or cooling a cooling bag 12. The bag is jammed between two L-shaped plates 13 and 14 which completely encompass the bag 12. The plates 13 and 14 are pressed together by way of pneumatic cylinders 15, 16, such that the cooling bag 12 is firmly held between the plates.

On their sides facing the bag 12, the plates 13 and 14 comprise a comb-like structure, shown in FIG. 5. In this way channels 17 form when the plates 13, 14 are pressed against the cooling bag 12, with coolant being able to rise in said channels 17, along the arrows 18, between the plates and the cooling bag 12.

The plates 13, 14 and the cooling bag 12 are arranged in a chamber 19 which is closed by a lid 20. The plates are arranged at a distance from the bottom of the chamber so as to allow streaming movement below the plate. By way of the pipe 21 and the pump 22, liquid nitrogen is pumped into this chamber. This liquid nitrogen first accumulates on the bottom of the chamber 19 before rising in the channels 17. In so doing it heats up and changes to the vapour phase. The channels 17 have a chimney effect leading to a particularly strong flow within the channels. In order to regulate this flow, flaps 23, 24 are provided at the entrance of the channels 17. The nitrogen emanating from the upper end of the channels 17 flows to a separator 25 which separates liquid nitrogen from gaseous nitrogen. The separator 25 comprises a vapour exit aperture through which the gaseous nitrogen is educted.

In those positions where the plates 13 and 14 are arranged directly between the coolant and the cooling bag 12, a microporous layer 26, 27 is provided which improves thermal transmission from the coolant to the plate and thus thermal transition to the cooling bag. The cooling performance could be further improved if the surface of the cooling bag 12, at least in the region of the channels 17 and/or further surface regions of the plates 13, 14 which are in contact with the liquid nitrogen, comprises a microporous layer.

The device 11 can be used according to the description relating to FIGS. 2 and 3.

FIG. 6 is a diagrammatic arrangement of a device according to FIG. 4 with heating elements 28 and 29 which are arranged on the sides of the plates 31 and 32, said sides facing the cooling bag 30. In this way the flow speed in the channels 34, 35 can be increased and regulated. A further heating element 36 is provided in the bottom region of the device, again so as to improve and regulate the flow of the coolant. In this variant, the liquid part of the coolant emerging upward is collected in a device (not shown).

FIG. 7 shows a further alternative embodiment of the device according to FIG. 4 comprising two heating devices 37, 38 for the holding devices 43, 44. In this variant, the coolant moves downward in the exterior region of a container 39; it is conducted to the channels 41 and 42 in the plates 43 and 44 by way of a funnel 40. Above the channels 41 and 42, deflectors 45, 46 are provided which return liquid coolants issuing from the channels 41, 42. Above the deflectors 45, 46, a lid 47 with a gas outlet 48 is provided. The liquid level 49 of the coolant is kept just above the cooling bag but below the deflectors 45, 46. In this way the consumption of liquid nitrogen is reduced.

In the embodiments according to FIG. 6 and 7, too, the lower inlet of the channels can be regulated by flaps.

The embodiments according to figs. 4, 5, 6 and 7 can either be operated so that the goods to be cooled and the container or the plates are at first held above the solidification temperature of the goods to be cooled, or the container or the plates can already be precooled and only the goods to be cooled can be held above the solidification temperature before they are placed into the device.

What is claimed is:

1. A sample-cooling device comprising at least one precooled body delimiting a cooling space for the sample, wherein at least one precooled body has a mass in grams that is at least 2.5 times the volume of the cooling space in milliliters, and wherein the precooled body comprises at least one space which permits formation of a contact surface and allows direct contact between a coolant and the sample.

2. A device for cooling a sample, the device comprising:

(a) a holding device arranged:

(i) to hold the sample in an essentially non-deformable manner; and (ii) to form at least one contact surface between the holding device and the sample; and (b) at least one space which permits formation of a contact surface and allows direct contact between a coolant and the sample.

3. The device of claim 2 wherein the contact surface between the holding device and the sample is smaller than the contact surface between the coolant and the sample.

4. The device of claim 2 wherein the holding device comprises guide channels for conducting the coolant.

5. The device of claim 4 wherein the guide channels comprise an inlet and an outlet and wherein the inlet is positioned at a level which is lower than the level of the outlet.

6. The device of claim 5 further comprising at least one adjustable flow-control device arranged to restrict flow of coolant at the inlet and/or the outlet.

7. The device of claim 2 wherein the holding device is arranged to hold a plate-shaped sample.

8. The device of claim 2 wherein the holding device is arranged to hold a sample having a cylindrical or a hollow-cylindrical shape.

9. A device for cooling a sample, the device comprising:

(a) a holding device arranged:

(i) to hold the sample in an essentially non-deformable manner; and (ii) to form at least one contact surface between the holding device and the sample;

(b) at least one space which permits formation of a contact surface and allows direct contact between a coolant and the sample; and (c) a heatable chamber surrounding the holding device.

10. The device of claim 9 wherein the chamber comprises an inlet for flowing coolant into the chamber.

11. The device of claim 9 wherein the chamber comprises an overflow and a separator for liquid coolant.

12. The device of claim 2, wherein the sample is a freezing bag filled with a liquid.

13. The device of claim 12, wherein the freezing bag comprises a microporous surface.

14. The device of claim 12, wherein the holding device is kept at a temperature that is below the solidification temperature of the liquid in the freezing bag prior to cooling of said freezing bag.

15. The device of claim 12, wherein the holding device is kept at a temperature that is above the solidification temperature of the liquid in the freezing bag prior to cooling of said freezing bag.

16. The device of claim 2, wherein the holding device is pressed against the sample at an essentially constant pressure.

17. The device of claim 2, wherein the contact surface between the holding device and the sample comprises a microporous surface.

* * * * *

UNITED STATES PATENT AND TRADEMARK OFFICE

CERTIFICATE OF CORRECTION

PATENT NO. : 6,393,860 B1
APPLICATION NO. : 09/486093
DATED : May 28, 2002
INVENTOR(S) : Heschel et al.

It is certified that error appears in the above-identified patent and that said Letters Patent is hereby corrected as shown below:

Add new Title page attached

Replace Column 1 thru Column 8 with the attached

This certificate supersedes Certificate of Correction issued January 11, 2005.

Signed and Sealed this

Sixteenth Day of January, 2007

JON W. DUDAS
*Director of the United States Patent and Trademark Office*

(12) United States Patent
Heschel et al.

(10) Patent No.: US 6,393,860 B1
(45) Date of Patent: May 28, 2002

(54) METHOD AND DEVICE FOR REFRIGERATING, ESPECIALLY FREEZING, GOODS

(76) Inventors: Ingo Heschel; Guenter Rau, both of Pauwelsstrasse 20, Aachen (DE), D-52074

( * ) Notice: Subject to any disclaimer, the term of this patent is extended or adjusted under 35 U.S.C. 154(b) by 0 days.

(21) Appl. No.: 09/486,093

(22) PCT Filed: Aug. 20, 1998

(86) PCT No.: PCT/DE98/02427

§ 371 (c)(1),
(2), (4) Date: May 12, 2000

(87) PCT Pub. No.: WO99/10693

PCT Pub. Date: Mar. 4, 1999

(30) Foreign Application Priority Data

Aug. 21, 1997 (DE) ..... 197 36 372

(51) Int. Cl.[7] ..... F25D 17/02
(52) U.S. Cl. ..... 62/376; 62/64
(58) Field of Search ..... 62/341, 373, 374, 62/375, 376, 64

(56) References Cited

U.S. PATENT DOCUMENTS 3,074,247 A * 1/1963 Polk
4,018,911 A 4/1977 Licaetti et al. ..... 424/101
4,251,995 A * 2/1981 Peri et al. ..... 62/341
4,480,682 A * 11/1984 Kaneta et al. ..... 62/434
4,799,358 A * 1/1989 Knopf et al. ..... 62/457

FOREIGN PATENT DOCUMENTS

| | | |
|---|---|---|
| DE | 31 42 521 C2 | 7/1983 |
| DE | 38 22 589 A1 | 1/1990 |
| DE | 42 06 705 A1 | 9/1993 |
| DE | 44 37 091 A1 | 4/1996 |
| DE | 196 19 152 A1 | 11/1997 |
| EP | 0 448 292 A2 | 9/1991 |
| EP | 0 475 144 A2 | 3/1992 |
| EP | 0 475 144 A3 | 3/1992 |
| FR | 2 632 391 A1 | 6/1988 |
| WO | WO 95/21351 | 7/1996 |

* cited by examiner

*Primary Examiner*—Henry Bennett
*Assistant Examiner*—Mohammad M. Ali
(74) *Attorney, Agent, or Firm*—Steven J. Hultquist

(57) ABSTRACT

To improve the thermal transmission during freezing processes it is proposed that the goods to be cooled and a pre-cooled body of high thermal capacity be pressed against each other.

Improved thermal transmission is also attained with a device comprising a holding device which during the cooling process holds the goods to be cooled essentially in a non-deformable way, allowing direct contact between the coolant and the goods to be cooled. Preferably, vertically aligned channels are arranged between the holding device and the goods to be cooled, with coolant flowing in said channels.

17 Claims, 2 Drawing Sheets

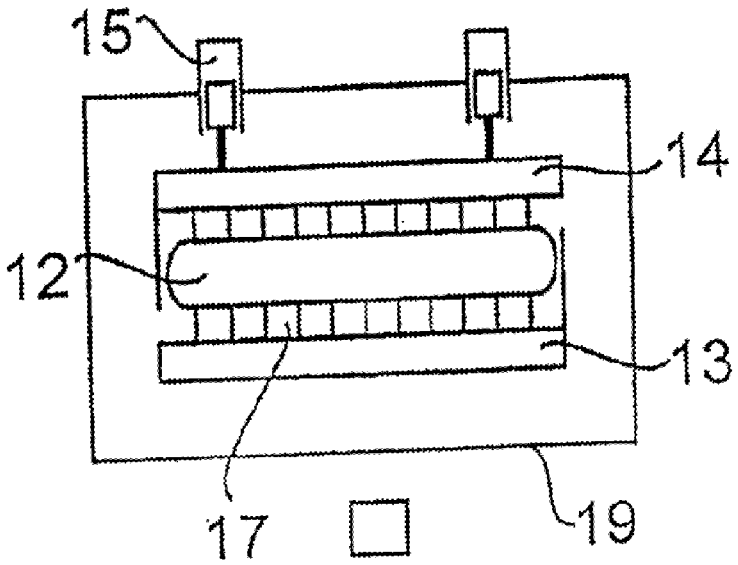

METHOD AND DEVICE FOR REFRIGERATING, ESPECIALLY FREEZING, GOODS

The invention relates to a method and a device for cooling, in particular freezing, goods to be cooled, in particular biological materials.

Devices and methods for freezing biological materials are known from cryobiology.

In many fields of biological specimen preparation as well as intense-cooling conservation or vitrification of cells, organs or organisms or other biological materials, for various reasons it is crucial to cool specimens as fast as possible.

In the case of biological specimen preparation by cryotechniques e.g. for histology examinations, it is important that the specimen morphology be maintained as far as possible in spite of cooling the specimen. This requires rapid cooling to keep the extent of ice formation to a minimum.

Devices for freezing blood cells are particularly well researched. With these devices, antifreeze additives such as for example hydroxyethyl starch (HES) or glycerine is added to the blood components; said additives are necessary to achieve an adequate cell survival rate after the freeze-thaw process. The blood components present in a film bag are placed in a container which is subsequently cooled by immersion in e.g. liquid nitrogen.

To achieve a good ratio of surface to volume at the bag and to avoid creases and bulges at the bag, DE 31 42 521 C2 and DE A 44 37 091 propose that the bag be held between two plates arranged parallel in respect of each other, and that the bag be cooled in the liquid nitrogen together with the holding device. A similar holding device is also known from WO 90/09184.

While the known holding devices provide the advantage of achieving a good ratio of surface to volume at the bag, they have a disadvantage in that thermal transmission from the coolant to the biological material is impeded by the holding device.

It is thus the object of the invention to provide a method and a device of the generic type which allow acceleration of the cooling process of goods to be cooled.

From the point of view of the method, this object is met in that the goods to be cooled are pressed against a precooled body of high thermal capacity.

The precooled body of high thermal capacity provides the advantage that, at least for an initial period of time, during heat absorption from the goods to be cooled, the body does not require aftercooling, and that the high thermal capacity of the body is selected such that ideally the body can absorb the entire heat released from the goods to be cooled without becoming significantly warmer. Consequently, thermal transition from the goods to be cooled to the coolant via the body, is not necessary during the rapid cooling process.

Advantageously, the selected thermal capacity of the precooled body is sufficient for the goods to be cooled, which are above solidification temperature, to be cooled without aftercooling to at least −18° Celsius, preferably to at least −30° Celsius. In particular, the method can be applied such that such a coolant is cooled to below solidification temperature, even if the solidification temperature strictly speaking covers a certain solidification temperature interval. The thermal capacity of the precooled body can also be selected to be sufficient for the goods to be cooled, which are at a temperature above solidification temperature, to be cooled to below glass transition temperature without aftercooling. As a result of this, the cooling process takes place in a particularly suitable manner, in particular also for vitrification.

To achieve particularly good thermal transmission from the cooled body to the goods to be cooled, according to the invention the cooled body and the goods to be cooled are pressed against each other. The pressures generated during this process of pressing together range from 0.01 bar to 4 bar (advantageously 0.1 bar to 0.4 bar overpressure) improve thermal transmission from the precooled body to the goods to be cooled. Even if the goods to be cooled are contained in a film bag, as a result of the high pressure exerted, thermal transmission from the cooled body to the film bag and from the film bag to the goods to be cooled, is improved.

By combining the use of a body of high thermal capacity and contact at high pressure, of the body to the goods to be cooled, particularly fast cooling of the goods to be cooled can be achieved so that in the case of biological material any damage to the material is prevented or at least reduced.

To achieve area contact between the cooled body and the goods to be cooled, it is proposed that the surface of the body be matched to the shape of the goods to be cooled. In the case of liquid goods to be cooled, packed in bags, the body can either be matched to the bag shape or it can press the bag into a particular shape. Liquid or deformable goods to be cooled can for example be shaped to plates to reduce the length of the thermal transition -in the goods to be cooled. By deforming the surface for example to a wave, the area of thermal transmission can be increased so as to achieve improved thermal transmission.

A further increase in thermal transmission between cooled body and goods to be cooled is achieved in that the surface is polished. A surface which is as smooth as possible prevents air inclusion between the goods to be cooled and the cooled body, as such air inclusion would impede thermal transmission.

To further force the rate of cooling it is proposed that the goods to be cooled be pressed between at least two bodies of high thermal capacity. This makes it possible to cool the goods to be cooled from several sides so as to achieve rapid cooling within the goods to be cooled.

An advantageous embodiment of the invention provides for respective surfaces of cooled bodies, arranged opposite each other, to be pressed onto the goods to be cooled so that the goods to be cooled are located in a narrow gap which for example is wave-shaped.

In order to cool the entire surface of the goods to be cooled it is proposed that the body or bodies encompass the goods to be cooled. This provides a further advantage in that the goods to be cooled are not uncontrollably deformed as a result of the forces acting on them, and that bags filled with liquid do not burst.

If the thermal capacity of the body is insufficient for achieving the required cooling rate, it is proposed that a coolant be conducted through the body. In this way the body can be aftercooled during heat absorption and in addition it is possible to cool the body again by means of the coolant guided through it, after it has released the cold. Alternatively or additionally, the body itself can be located in coolant so that coolant streams around it.

The object of the invention is also met by a device for cooling, in particular freezing, goods to be cooled, in particular biological material, in which at least one precooled body delimits a cooling space for the goods to be cooled, in that the mass of the precooled body in g (gram) is at least two point five (2.5) times the volume of the cooling space in ml (milliliters).

Such a ratio can ensure an excellent cooling process of the goods to be cooled which allows sufficiently rapid cooling for many purposes. In this context, cooling space refers to the volume which during cooling is taken up by the goods to be cooled or which is delimited by the precooled body.

Improved results can be achieved if the above-mentioned ratio is at least five (5). In particular from a ratio of thirty (30), preferably from a ratio of fifty (50) a device results which ensures particularly fast cooling rates. The devices described above are particularly suitable for goods to be cooled from 1 mg mass upward. In particular they are suitable for goods to be cooled above 1 g or for macroscopic goods to be cooled, such as for example cool conserves.

The object of the invention is also met by a device comprising a holding device which during the cooling process holds the goods to be cooled essentially in a non-deformable way and which allows direct contact between the coolant and the goods to be cooled.

Another object of the invention is met by a process for cooling, in particular freezing, goods to be cooled, in particular biological materials, in which during the cooling process the goods to be cooled are essentially held in a non-deformable way and brought into direct contact with a coolant in at least one space.

Preferably, the space extends at least partly along the goods to be cooled.

The holding device according to the invention is constructed such that it holds in particular liquid blood components filled into bags in a shape that is advantageous for cooling while nevertheless allowing direct contact between the coolant and the goods to be cooled. This not only results in optimum holding of the goods to be cooled but also in avoiding the problems, known from the state of the art, of thermal transmission from the goods to be cooled through the holding device into the coolant.

To achieve good thermal transmission from the goods to be cooled to the coolant, it is proposed that the contact surface between the holding device and the goods to be cooled be smaller than the contact surface between the coolant and the goods to be cooled.

An advantageous embodiment of the device provides for the holding device to comprise guide channels for conducting the coolant. In particular in the case of boiling coolants, this allows free convection or pumping of the coolant through the channels.

Trials have shown that convection through evaporation itself, within the described guide channels, results in strong acceleration of the coolant if the inlet of the guide channels is arranged lower than their outlet.

This chimney effect is so pronounced that it is proposed that flow-control devices which are adjustable so as to restrict the flow, be arranged at the inlet and/or the outlet. This makes it possible to achieve control or regulation of the coolant flow in a simple way. It is advantageous if the adjustable flow-control devices are adjustable also during the cooling process, so that variations in the cooling rates between the margin and the middle of the specimen can be compensated for by regulation, because otherwise different local survival rates could result.

Simple construction of the device is achieved in that the holding device holds the goods to be cooled in the form of a plate. In particular good cooling rates can be achieved by cooling both sides of the plate-shaped goods to be cooled.

The goods to be cooled can however also be held in the form of a cylinder. Particularly advantageous is a holding device which holds the goods to be cooled in the form of a hollow cylinder because in this way the goods to be cooled encompass a hollow space which can serve as a guide channel for the coolant.

Since in the range of the boiling temperature of the coolant the best cooling rate can be achieved with nucleate boiling, a chamber is proposed into which the holding device can be inserted, with said chamber preferably being heatable. The ability to heat the chamber allows precise setting of the evaporation rate of the coolant and thus of the convection. Alternatively or additionally, the holding device itself can be constructed so as to be heatable.

It is advantageous if the chamber comprises an inlet with a coolant pump. In this way forced flow of the coolant through the chamber and between the goods to be cooled and the holding device can be achieved, with said forced flow improving the thermal transmission from the goods to be cooled to the coolant.

A preferred embodiment provides for the chamber to comprise an overflow and a separator for liquid coolant. While the liquid coolant is used for further cooling, the gaseous part of the coolant is either discarded or liquefied in a connected device.

A preferred use of the method or the device described comprises the freezing of bags filled with a liquid, in particular blood components. These bags are flexible in shape; they have to be cooled as fast as possible. Although antifreeze additives limit the damage to blood components, particularly high rates of cooling should be achieved. This can be achieved in a simple way with the method or device described.

When cooling bodies and in particular when cooling liquids, the volume of the goods to be cooled changes, in the case of aqueous systems in addition also due to crystallization. It is thus proposed that the body or the holding device described essentially be pressed against the goods to be cooled, at a constant pressure. This can for example be achieved by a pre-tensioned spring with flat spring characteristics, with pneumatic or hydraulic devices. In particular, a hydraulic or pneumatic device with respective control makes it possible to keep the pressure against the goods to be cooled essentially constant. Although the volume increase during crystallization can principally be absorbed by regulating the pressure, it is additionally advantageous if the film bag is not completely filled, but instead, if a gas cushion is left above the goods to be frozen. In this way the welded seams of the bag are not unduly stressed by the expansion in volume.

In order to improve the thermal transmission at the body or at the holding device, it is proposed that the body or the holding device comprise a microporous surface on the side of the coolant. To form a microporous surface, either the surface itself can be roughened or an adhesive layer with a microporous surface, for example Lykosilk® can be applied to the surface. It is particularly advantageous if this microporous layer is fixed directly to the bag.

Depending on the device selected, or depending on the desired cooling progression, prior to cooling the goods to be cooled, the temperature of the body or of the holding device can be below the solidification temperature of the goods to be cooled. But it is also possible that the temperature of the body or of the holding device is above the solidification temperature of the goods to be cooled.

To illustrate the method and the device described, several embodiments are shown in the drawing and are described in more detail below. The following are shown:

FIG. 1 a diagrammatic view of a device for pressing cooled bodies against goods to be cooled;

FIG. 2 the principle of horizontal feeding-in of goods to be cooled;

FIG. 3 the principle of vertical feeding-in of goods to be cooled;

FIG. 4 a diagrammatic lateral view of a device with a holding device with cooling ribs;

FIG. 5 a section through the device according to FIG. 4;

FIG. 6 a diagrammatic view of a device for free convection with heating device; and FIG. 7 an alternative embodiment of a device for free convection with heating device.

The device 1 shown in FIG. 1 serves to cool a cooling bag 2 held between two plates 3 and 4. These plates 3 and 4 in a cooling space 10 are made from metal such as steel or preferably copper; they have a high thermal capacity. A pneumatic cylinder 5 is connected to the plate 3 by way of a piston rod 6 so that the plate 3 can be pressed with considerable force parallel against the cooling bag 2. As a result, the cooling bag 2 is jammed between the plates 3 and 4. As an alternative, guiding the plates 3 and 4 can also be realized by a pulley system or by a system comprising one or several cogs, joints or chains. In this way the movement of the plate can take place by way of a drive arranged outside the intensely cooled region, for example by way of a pneumatic cylinder. Plates 3 and 4 can either be cooled by liquid nitrogen streaming over them, or by liquid nitrogen being conducted through the pipelines 7 through the plates so as to cool the plates. To increase thermal transmission within the pipelines 7, the interior surfaces of the pipes are coated with a microporous layer 8.

The use of the device 1 is shown diagrammatically in FIG. 2. First at least one plate is cooled down to the desired temperature by means of liquid nitrogen 9; subsequently a cooling bag 2 is placed onto the lower plate 4 by means of a special template. In this connection, existing circular punchouts at the margin of the cooling bags can be used to fix the cooling bag within the cooling container, for example by holding arbours. By means of the pneumatic device 5, the plate 3 is pressed against the cooling bag 2 so that the heat from bag 2 is transferred to the plates 3 and 4. After cooling of the cooling bag 2, the plate 3 is raised by means of the pneumatic device 5, and the cooling bag 2 is removed from the device 1 in the direction of the actuation arrow 10.

FIG. 3 shows an alternative variant of the device. In this device 1' the cooling bag 2' is placed between two vertically arranged plates 3' and 4' and the cooled plates 3' and 4' are pressed against the bag 2' by means of the pneumatic device 5'. After cooling the bag 2' it is removed from the device 1' in vertical direction according to the actuation arrow 10'.

FIG. 4 shows a further device 11 for freezing or cooling a cooling bag 12. The bag is jammed between two L-shaped plates 13 and 14 which completely encompass the bag 12. The plates 13 and 14 are pressed together by way of pneumatic cylinders 15, 16, such that the cooling bag 12 is firmly held between the plates.

On their sides facing the bag 12, the plates 13 and 14 comprise a comb-like structure, shown in FIG. 5. In this way channels 17 form when the plates 13, 14 are pressed against the cooling bag 12, with coolant being able to rise in said channels 17, along the arrows 18, between the plates and the cooling bag 12.

The plates 13, 14 and the cooling bag 12 are arranged in a chamber 19 which is closed by a lid 20. The plates are arranged at a distance from the bottom of the chamber so as to allow streaming movement below the plate. By way of the pipe 21 and the pump 22, liquid nitrogen is pumped into this chamber. This liquid nitrogen first accumulates on the bottom of the chamber 19 before rising in the channels 17. In so doing it heats up and changes to the vapour phase. The channels 17 have a chimney effect leading to a particularly strong flow within the channels. In order to regulate this flow, flaps 23, 24 are provided at the entrance of the channels 17. The nitrogen emanating from the upper end of the channels 17 flows to a separator 25 which separates liquid nitrogen from gaseous nitrogen. The separator 25 comprises a vapour exit aperture through which the gaseous nitrogen is educted.

In those positions where the plates 13 and 14 are arranged directly between the coolant and the cooling bag 12, a microporous layer 26, 27 is provided which improves thermal transmission from the coolant to the plate and thus thermal transition to the cooling bag. The cooling performance could be further improved if the surface of the cooling bag 12, at least in the region of the channels 17 and/or further surface regions of the plates 13, 14 which are in contact with the liquid nitrogen, comprises a microporous layer.

The device 11 can be used according to the description relating to FIGS. 2 and 3.

FIG. 6 is a diagrammatic arrangement of a device according to FIG. 4 with heating elements 28 and 29 which are arranged on the sides of the plates 31 and 32, said sides facing the cooling bag 30. In this way the flow speed in the channels 34, 35 can be increased and regulated. A further heating element 36 is provided in the bottom region of the device, again so as to improve and regulate the flow of the coolant. In this variant, the liquid part of the coolant emerging upward is collected in a device (not shown).

FIG. 7 shows a further alternative embodiment of the device according to FIG. 4 comprising two heating devices 37, 38 for the holding devices 43, 44. In this variant, the coolant moves downward in the exterior region of a container 39; it is conducted to the channels 41 and 42 in the plates 43 and 44 by way of a funnel 40. Above the channels 41 and 42, deflectors 45, 46 are provided which return liquid coolants issuing from the channels 41, 42. Above the deflectors 45, 46, a lid 47 with a gas outlet 48 is provided. The liquid level 49 of the coolant is kept just above the cooling bag but below the deflectors 45, 46. In this way the consumption of liquid nitrogen is reduced.

In the embodiments according to FIG. 6 and 7, too, the lower inlet of the channels can be regulated by flaps.

The embodiments according to figs. 4, 5, 6 and 7 can either be operated so that the goods to be cooled and the container or the plates are at first held above the solidification temperature of the goods to be cooled, or the container or the plates can already be precooled and only the goods to be cooled can be held above the solidification temperature before they are placed into the device.

What is claimed is:

1. A sample-cooling device comprising at least one precooled body delimiting a cooling space for the sample, wherein at least one precooled body has a mass in grams that is at least 2.5 times the volume of the cooling space in milliliters, and wherein the precooled body comprises at least one space which permits formation of a contact surface and allows direct contact between a coolant and the sample.

2. A device for cooling a sample, the device comprising:

(a) a holding device arranged:

(i) to hold the sample in an essentially non-deformable manner; and (ii) to form at least one contact surface between the holding device and the sample; and (b) at least one space which permits formation of a contact surface and allows direct contact between a coolant and the sample.

3. The device of claim 2 wherein the contact surface between the holding device and the sample is smaller than the contact surface between the coolant and the sample.

4. The device of claim 2 wherein the holding device comprises guide channels for conducting the coolant.

5. The device of claim 4 wherein the guide channels comprise an inlet and an outlet and wherein the inlet is positioned at a level which is lower than the level of the outlet.

6. The device of claim 5 further comprising at least one adjustable flow-control device arranged to restrict flow of coolant at the inlet and/or the outlet.

7. The device of claim 2 wherein the holding device is arranged to hold a plate-shaped sample.

8. The device of claim 2 wherein the holding device is arranged to hold a sample having a cylindrical or a hollow-cylindrical shape.

9. A device for cooling a sample, the device comprising:

(a) a holding device arranged:

(i) to hold the sample in an essentially non-deformable manner; and (ii) to form at least one contact surface between the holding device and the sample;

(b) at least one space which permits formation of a contact surface and allows direct contact between a coolant and the sample; and (c) a heatable chamber surrounding the holding device.

10. The device of claim 9 wherein the chamber comprises an inlet for flowing coolant into the chamber.

11. The device of claim 9 wherein the chamber comprises an overflow and a separator for liquid coolant.

12. The device of claim 2, wherein the sample is a freezing bag filled with a liquid.

13. The device of claim 12, wherein the freezing bag comprises a microporous surface.

14. The device of claim 12, wherein the holding device is kept at a temperature that is below the solidification temperature of the liquid in the freezing bag prior to cooling of said freezing bag.

15. The device of claim 12, wherein the holding device is kept at a temperature that is above the solidification temperature of the liquid in the freezing bag prior to cooling of said freezing bag.

16. The device of claim 2, wherein the holding device is pressed against the sample at an essentially constant pressure.

17. The device of claim 2, wherein the contact surface between the holding device and the sample comprises a microporous surface.

* * * * *

UNITED STATES PATENT AND TRADEMARK OFFICE

CERTIFICATE OF CORRECTION

PATENT NO. : 6,393,860 B1
APPLICATION NO. : 09/486093
DATED : May 28, 2002
INVENTOR(S) : Heschel et al.

It is certified that error appears in the above-identified patent and that said Letters Patent is hereby corrected as shown below:

Column 2, line 24: "transition -in" should be -- transition in --.

Column 4, line 49: "Lykosilk" should be -- Leukosilk --.

Signed and Sealed this

Fourteenth Day of August, 2007

JON W. DUDAS
*Director of the United States Patent and Trademark Office*